US007897874B2

(12) United States Patent
Park et al.

(10) Patent No.: US 7,897,874 B2
(45) Date of Patent: Mar. 1, 2011

(54) FOAM COAXIAL CABLE AND METHOD FOR MANUFACTURING THE SAME

(75) Inventors: Chan-Yong Park, Seoul (KR); Bong-Kwon Cho, Busan (KR); Gi-Joon Nam, Seoul (KR); Jung-Won Park, Seongnam-si (KR); Dae-Sung Lee, Gumi-si (KR)

(73) Assignee: LS Cable Ltd., Anyang-si, Gyeonggi-do (KR)

( * ) Notice: Subject to any disclaimer, the term of this patent is extended or adjusted under 35 U.S.C. 154(b) by 187 days.

(21) Appl. No.: 12/377,842

(22) PCT Filed: Aug. 10, 2007

(86) PCT No.: PCT/KR2007/003858

§ 371 (c)(1),
(2), (4) Date: Feb. 17, 2009

(87) PCT Pub. No.: WO2008/020694

PCT Pub. Date: Feb. 21, 2008

(65) Prior Publication Data

US 2010/0230130 A1 Sep. 16, 2010

(30) Foreign Application Priority Data

Aug. 17, 2006 (KR) ..... 10-2006-0077650

(51) Int. Cl.
*H01B 7/00* (2006.01)

(52) U.S. Cl. ..... 174/110 R; 174/110 PM; 174/116

(58) Field of Classification Search ..... 174/110 R, 174/102 R, 110 F, 110 PM, 116, 120 R, 24, 174/28

See application file for complete search history.

(56) References Cited

U.S. PATENT DOCUMENTS 4,886,212 A 12/1989 Proctor et al.

(Continued)

FOREIGN PATENT DOCUMENTS

JP 09-270631 10/1997

(Continued)

OTHER PUBLICATIONS

International Search Report, completed Oct. 30, 2007 for International Application No. PCT/KR2007/003858, filed Aug. 10, 2007.

*Primary Examiner*—William H Mayo, III
(74) *Attorney, Agent, or Firm*—Sherr & Vaughn, PLLC

(57) ABSTRACT

A foam coaxial cable includes a central conductor; an inner skin layer surrounding the central conductor coaxially; an insulation layer surrounding the inner skin layer coaxially and made of polyethylene resin containing a plurality of foam cells uniformly formed therein; wherein the inner skin layer is made of polyolefin resin having excellent compatibility with the polyethylene resin to increase an interfacial adhesive force with the insulation layer, an outer skin layer surrounding the insulation layer coaxially to prevent overfoaming of the insulation layer and allow uniform creation of foam cells; a shield surrounding the outer skin layer coaxially; and a jacket surrounding the shield. This cable improves an interfacial adhesive force between the central conductor and the insulation layer and also improves the degree of foam of the foam cells, thereby capable of propagating ultra high frequency of GHz level without signal interference.

14 Claims, 2 Drawing Sheets

U.S. PATENT DOCUMENTS

| | | | | |
|---|---|---|---|---|
| 4,965,412 | A | 10/1990 | Lai et al. | |
| 5,946,798 | A | 9/1999 | Buluschek | |
| 6,130,385 | A | 10/2000 | Tuunanen et al. | |
| 6,180,721 | B1 * | 1/2001 | Rogestedt et al. | 525/191 |
| 6,417,454 | B1 | 7/2002 | Biebuyck | |
| 6,912,777 | B2 | 7/2005 | Carlson et al. | |
| 2003/0051897 | A1 | 3/2003 | Blouin et al. | |
| 2006/0219425 | A1 * | 10/2006 | Fagrell et al. | 174/110 PM |
| 2008/0166537 | A1 * | 7/2008 | Frankowski et al. | 428/304.4 |
| 2010/0212935 | A1 * | 8/2010 | Cho et al. | 174/116 |

FOREIGN PATENT DOCUMENTS

| | | |
|---|---|---|
| JP | 10-040744 | 2/1998 |
| JP | 10-334750 | 12/1998 |
| JP | 2000-048653 | 2/2000 |
| JP | 2003-187649 | 7/2003 |
| KR | 10-2006-0021860 | 3/2006 |

* cited by examiner

[Fig. 1]
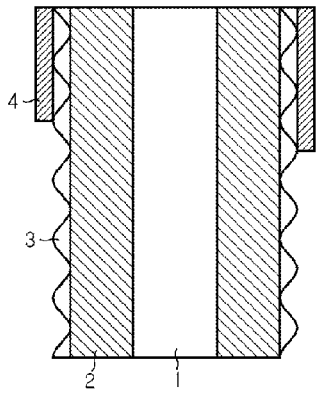
[Fig. 2]
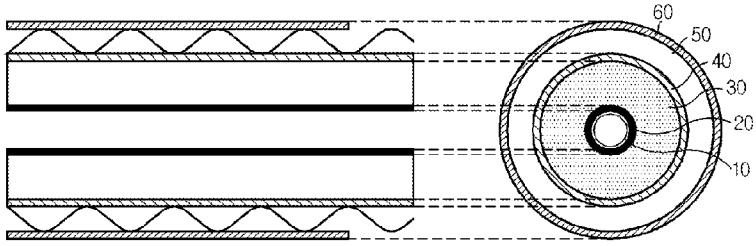
[Fig. 3]
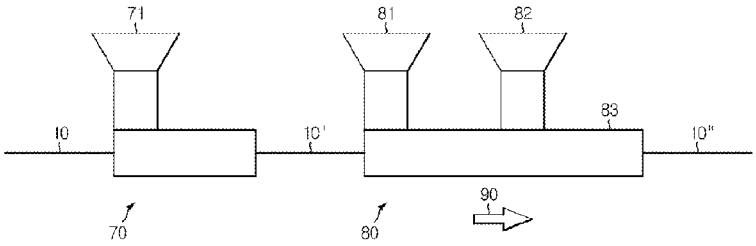
[Fig. 4]
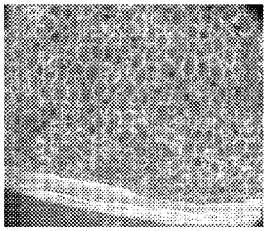
[Fig. 5]
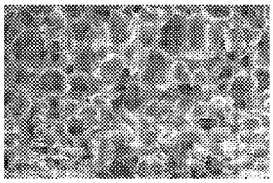
[Fig. 6]
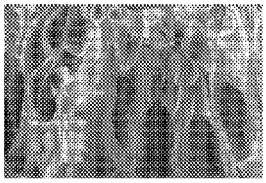

[Fig. 7]
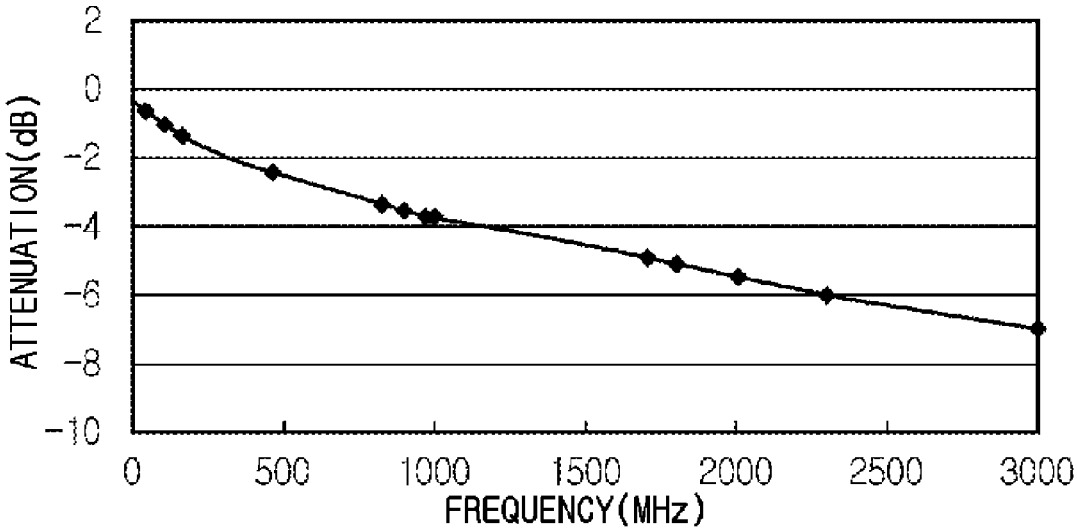
[Fig. 8]
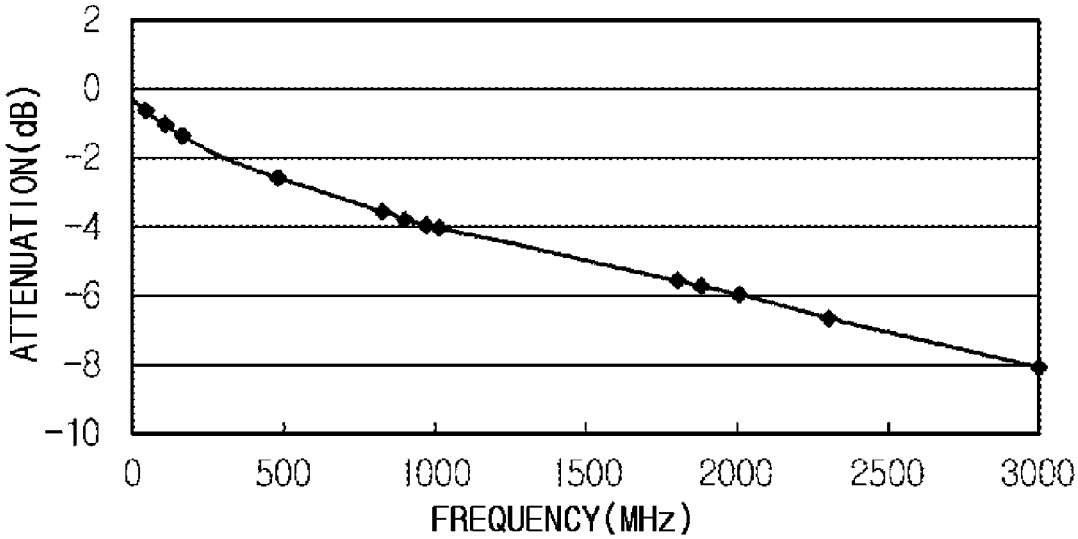

FOAM COAXIAL CABLE AND METHOD FOR MANUFACTURING THE SAME

CROSS-REFERENCE TO RELATED APPLICATIONS

This application is a national stage application under 35 U.S.C. 371 based on and claiming the benefit of International Application Serial No. PCT/KR2007/003858 filed on Aug. 10, 2007 and the benefit of priority from Korean Application No. 10-2006-0077650 filed on Aug. 17, 2006 the entire contents of each of which are incorporated herein by reference.

TECHNICAL FIELD

The present invention relates to a foam coaxial cable, and more particularly to a coaxial cable having excellent propagation properties with a reduced loss caused by signal propagation by improving an intercalated structure of the coaxial cable to give better permittivity.

BACKGROUND ART

Generally, a coaxial cable is a transmission line including a central conductor for transmitting signals, and a shield coaxially formed on the central conductor. Seeing the inside section of the line, the central conductor and the shield are coaxially arranged, and an insulation layer having a dielectric feature is formed between the central conductor and the shield.

Various kinds of coaxial cables with various sizes have been developed, and such a coaxial cable is advantageous since attenuation of signal and change of propagation delay caused by frequency are small owing to its structural features, a large amount of data may be transmitted in a lump, and various coaxial cables may be received in the same cable while ensuring little leakage of signal among them.

An impedance characteristic is the most essential factor of the coaxial cable, and an impedance value is decided based on the following Equation 1. At this time, in the Equation 1, $Z_0$ is a characteristic impedance, $\epsilon_r$ is a permittivity, d is a diameter of the central conductor, and D is an inner diameter of the shield.

$$Z_0 = \frac{138}{\sqrt{\varepsilon_r}}\log\frac{D}{d} \qquad \text{Equation 1}$$

As seen from the Equation 1, factors determining a characteristic impedance includes a permittivity, a diameter of the central conductor, and a diameter of the shield. At this time, the permittivity is increased or decreased depending on the degree of foam of the insulation layer, and a propagation velocity is increased or decreased depending on the permittivity. Here, the propagation velocity satisfies the following Equation 2. At this time, in the following Equation 2, $\upsilon_p$ is a propagation velocity, $\epsilon_{r,exp}$ is a permittivity after foaming, $\epsilon_{r,sol}$ is a permittivity before foaming, $\rho_{exp}$ is a density after foaming, and $\rho_{sol}$ is a density before foaming.

$$v_p = \frac{1}{\sqrt{\varepsilon_r}} \qquad \text{Equation 2}$$

$$\varepsilon_{r,exp} = co\log\left(\frac{\rho_{exp}}{\rho_{sol}}\log\varepsilon_{r,sol}\right)$$

As seen from the Equation 2, a permittivity is lowered as the degree of foam is increased, and a propagation velocity is improved as the permittivity is lowered. That is to say, the loss characteristic depending on signal propagation is improved. At this time, as foam cells composed in an insulation layer after foaming have higher density and uniformity, the degree of foam is increased.

Meanwhile, to improve the substantial loss characteristic of the coaxial cable, the diameters of the central conductor and the shield should not be nearly increased in a generally used cable. That is to say, if a propagation frequency reaches a high level of several GHz, the coaxial cable is confronted with a limit of high frequency due to the TEM (Transverse Electro Magnetic) mode. In addition, in case the materials of the central conductor and the shield are substituted with metal having excellent conductive properties, its performance in comparison to a manufacture cost is inefficient.

Thus, a desirable solution for improving the loss characteristic of the coaxial cable is to improve permittivity and structure of the insulation layer.

Recent studies for coaxial cables are directed to improving a structure between a central conductor and a shield and thus improving propagation features in order to reduce an energy loss caused by signal propagation. U.S. Pat. No. 6,912,777 and U.S. Pat. No. 4,866,212 disclose a coaxial cable in which an air layer with a lowest permittivity is arranged to surround the central conductor. In addition, as shown in FIG. 1, a wrinkled shield 3 is provided to surround a central conductor 1 and a shield 2, thereby improving a loss characteristic according to signal propagation.

Also, U.S. Pat. No. 6,130,385, U.S. Pat. No. 4,965,412 and US 2003/0051897 disclose a technique for improving a loss characteristic according to signal propagation by providing a metal layer or a film layer deposited with metal, which excellently shields electromagnetic wave, to an inner or outer side of the shield.

In addition, JP 1997-141990, JP 1998-217484 and JP 2001-387541 disclose a technique for improving a loss characteristic according to signal propagation by providing a skin layer surrounding an outer circumference of an insulation layer.

The above conventional techniques improve a loss characteristic in consideration of diameter and material of the central conductor and the shield, but they are confronted with a limit of high frequency or insufficient in performance compared with a manufacture cost. Also, the conventional techniques have a problem that a propagation characteristic is deteriorated due to low density and uniformity of foam cells since foam cells have irregular sizes or lumps with each other. Moreover, a low degree of foam causes local differences of permittivity and unbalanced outer diameters of the coaxial cable, and it also acts as a limitation factor in making a coaxial cable with a large caliber.

Recently, studies for lowering a permittivity by foaming polymer material are frequently progressed, and many efforts are consumed for using a high frequency of several hundred MHz or several GHz as a usable frequency so as to propagate more information. Accordingly, it is an important issue to develop a polymer insulation layer with a low loss.

DISCLOSURE OF INVENTION

Technical Problem

The present invention is designed in consideration of the above problems, and therefore it is an object of the invention to provide a foam coaxial cable having no local difference of permittivity with improved loss characteristic according to high frequency propagation by improving an interfacial adhesive force and foam uniformity of a foam insulation layer for the foam coaxial cable.

Technical Solution

In order to accomplish the above object, the present invention provides a foam coaxial cable, which includes a central conductor; an inner skin layer surrounding an outer circumference of the central conductor on the basis of the central conductor; an insulation layer surrounding an outer circumference of the inner skin layer on the basis of the central conductor and made of polyethylene resin containing a plurality of foam cells uniformly formed therein; wherein the inner skin layer is made of polyolefin resin having excellent compatibility with the polyethylene resin so as to increase an interfacial adhesive force with the insulation layer, an outer skin layer surrounding an outer circumference of the insulation layer on the basis of the central conductor so as to prevent overfoaming of the insulation layer and allow uniform creation of foam cells; a shield surrounding the outer skin layer on the basis of the central conductor; and a jacket surrounding the shield.

Preferably, the central conductor is metal composed of copper or its alloy with a thickness of 0.5 mm, and the central conductor is a hollow cylinder with an outer diameter of 9 to 19 mm.

In the present invention, the inner skin layer may be a thin film coating layer made of polyolefin resin with a thickness of 0.01 to 1 mm.

According to the present invention, the insulation layer may be a foam insulation layer made of polyethylene resin with a thickness of 5 to 15 mm.

Preferably, the physical foaming is conducted in a way of injecting a foaming gas into a polyethylene resin to reach a supersaturated state, and the foaming gas is a mixed gas including carbon dioxide, nitrogen and Freon.

More preferably, the foam cells have a size of 100 to 1000 μm on the basis of an average diameter of long and short axes thereof.

According to the present invention, the outer skin layer may be an overfoaming prevention layer made of polymer resin with a thickness of 0.01 to 0.5 mm.

Preferably, the polymer resin is made of a single material or a mixture of at least two materials selected from the group consisting of polyethylene resin, polypropylene resin and polyethylene terephthalate resin.

In another aspect of the present invention, there is also provided a method for manufacturing a foam coaxial cable, which includes a central conductor, an insulation layer formed out of the central conductor, a shield formed out of the insulation layer, and a jacket formed on an outer circumference of the shield, the method including: (A) co-extruding a polyolefin resin in a melted state on an outer circumference of the central conductor to form an inner skin layer coated as a thin film thereon with a thickness of 0.01 to 0.1 mm; (B) co-extruding a polyethylene resin on an outer circumference of the inner skin layer to form an insulation layer having a thickness of 5 to 15 mm and uniformly including a plurality of foam cells with a size of 100 to 1000 μm on the basis of an average diameter of long and short axes thereof; (C) co-extruding a polymer resin, which is made of the same material as the insulation layer, on an outer circumference of the insulation layer to form an outer skin layer coated as a thin film thereon with a thickness of 0.01 to 0.5 mm; and (D) forming the shield and the jacket on an outer circumference of the outer skin layer.

Preferably, the physical foaming in the step (B) is conducted in a way of injecting a mixed gas of carbon dioxide, nitrogen and Freon into a polyethylene resin in a melted state to reach a supersaturated state such that a plurality of foam cells are created in the insulation layer.

More preferably, the polymer resin of the step (C) is made of a single material or a mixture of at least two materials selected from the group consisting of polyethylene resin, polypropylene resin and polyethylene terephthalate resin.

BRIEF DESCRIPTION OF THE DRAWINGS

Other objects and aspects of the present invention will become apparent from the following description of embodiments with reference to the accompanying drawing in which:

FIG. 1 is a sectional view schematically showing a conventional coaxial cable;

FIG. 2 is a sectional view showing a foam coaxial cable according to a preferred embodiment of the present invention;

FIG. 3 is a schematic view showing a co-extruder used for manufacturing the foam coaxial cable according to the preferred embodiment of the present invention;

FIG. 4 is a photograph showing sections of an insulation layer and an outer skin layer according to a preferred embodiment of the present invention;

FIGS. 5 and 6 are photographs showing sections of insulation layers according to comparative examples;

FIG. 7 is a graph showing a loss characteristic of the foam coaxial cable according to the preferred embodiment of the present invention; and FIG. 8 is a graph showing a loss characteristic of a foam coaxial cable according to a comparative example.

REFERENCE NUMERALS OF ESSENTIAL PARTS IN THE DRAWINGS

10: central conductor 20: inner skin layer
30: insulation layer 40: outer skin layer
50: shield 60: jacket

BEST MODE FOR CARRYING OUT THE INVENTION

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

FIG. 2 is a sectional view showing a foam coaxial cable according to a preferred embodiment of the present invention.

As shown in FIG. 2, the foam coaxial cable includes a central conductor 10, an inner skin layer 20 surrounding an outer circumference of the central conductor 10 in compact on the basis of the central conductor 10, an insulation layer 30 surrounding an outer circumference of the inner skin layer 20 in compact, an outer skin layer 40 surrounding an outer circumference of the insulation layer 30 in compact, a shield 50 surrounding the outer skin layer 40, and a jacket 60 surrounding the shield 50. At this time, the inner skin layer 20, the insulation layer 30, the outer skin layer 40, the shield 50 and the jacket 60 are laminated subsequently on the central conductor 10 coaxially.

The central conductor 10 is a central line of the foam coaxial cable, which is made of metal material with conductivity and has a hollow cylindrical shape with a diameter of 9 to 19 mm. The metal material may selectively adopt copper or its alloy with a thickness of 0.5 mm. At this time, the central conductor 10 is a transmission line of electromagnetic wave energy, namely high frequency signal, transmitted to/from the foam coaxial cable.

The inner skin layer 20 is a thin film coating layer provided between the central conductor 10 and the insulation layer 30 to enhance an interfacial adhesive force. The inner skin layer 20 contains polymer resin made of the same material as the insulation layer 30.

In this embodiment, the inner skin layer 20 adopts a polymer resin that does not give any influence on dielectric features of the insulation layer 30 but is capable of giving an interfacial characteristic without its own adhesive feature. In case the insulation layer 30 is made of polyethylene resin, the polymer resin preferably adopts polyolefin resin that is excellent in compatibility.

Here, the polyethylene resin is a single material or a polymer mixture of at least two materials selected from the group consisting of HDPE (High Density Polyethylene), MDPE (Medium Density Polyethylene), LDPE (Low Density Polyethylene) and LLDPE (Linear Low Density Polyethylene). Also, the polyolefin resin is a polymer mixture including polyethylene, polypropylene and/or polyisobutylene.

At this time, if the inner skin layer 20 has a thickness less than 0.01 mm, it is difficult to ensure uniform coating on the outer circumference of the central conductor 10. In addition, if the thin film coating layer has a thickness greater than 1 mm, a permittivity is increased to deteriorate a propagation velocity. Thus, the inner skin layer 20 preferably has a thickness in the range of 0.01 to 1 mm, more preferably 0.05 to 0.5 mm.

The insulation layer 30 is a dielectric layer provided between the central conductor 10 and the shield 50 to prevent any loss of electromagnetic wave energy, and the insulation layer 30 is made of dielectric substance that gives insulation between the central conductor 10 and the shield 50. The dielectric substance may selectively adopt foam plastic or plastic composite insulators. Preferably, a polyethylene resin physically foamed is selected to ensure low permittivity and good loss characteristic of the electromagnetic wave energy.

In this embodiment, the insulation layer 30 has a plurality of foam cells with a closed-cell shape. If the foam cells have a size less than 100 μm on the basis of an average diameter of long and short axes of the foam cells, it can be hardly realized using the current technology. In addition, the foam cells have a size greater than 1000 μm, intervals among the foam cells become irregular, so the foam coaxial cable may not easily keep its uniform outer diameter. Thus, the foam cells preferably have a size in the range of 100 to 1000 μm on the basis of the average diameter.

The outer skin layer 40 is an overfoaming prevention layer provided between the insulation layer 30 and the shield 50 to prevent overfoaming of the insulation layer 30 and bursting of foam cells provided in the insulation layer 30. The outer skin layer 40 contains polymer resin made of the same material as the insulation layer 30.

In this embodiment, the outer skin layer 40 adopts a polymer resin that prevents overfoaming of the insulation layer 30 and allows uniform creation of foam cells in the insulation layer 30 while the insulation layer 30 is foamed. In case the insulation layer 30 is made of polyethylene resin, the polymer resin may selectively adopt polyethylene, polypropylene, polyethylene terephthalate, or their mixtures.

Here, the outer skin layer 40 is cooled more rapidly than the insulation layer 30 during the manufacturing process of a foam coaxial cable, explained later, to control overfoaming. However, if the outer skin layer 40 has a thickness less than 0.01 mm, a cooling speed is insufficient, so foam cells are burst or lumped. In addition, of the outer skin layer 40 has a thickness greater than 0.5 mm, permittivity is increased to deteriorate a propagation velocity. Thus, the outer skin layer 40 preferably has a thickness in the range of 0.01 to 0.5 mm, more preferably 0.05 to 0.3 mm.

The shield 50 is an external conductor provided between the outer skin layer 40 and the jacket 60 to control a loss of electromagnetic wave. This external conductor is made of metal material with conductivity and realized as a cylindrical metal tube with a thickness of 0.2 to 0.6 mm. This metal material may selectively adopt copper or its alloy with a thickness of 0.2 to 0.6 mm. Also, wrinkled curves are formed on a surface of this metal tube such that its properties are not changed in spite of repeated bending.

The jacket 60 is a sheath made of polymer material to prevent corrosion of the shield 50 and any external impact. The jacket 60 is made of polyolefin material with a thickness of 1 to 2 mm.

In this embodiment, the foam coaxial cable including all of the layers 20 to 60 has a diameter of 25 to 55 mm.

Among the components of the above foam coaxial cable, the inner skin layer 20, the insulation layer 30 and the outer skin layer 40 are subsequently co-extruded onto the central conductor 10 and then laminated thereon with forming concentric circles. Now, a method for manufacturing the foam coaxial cable according to the present invention will be explained as follows with reference to a co-extruder shown in FIG. 3.

As shown in FIG. 3, the central conductor 10 is passed through a first co-extruder 70 to make a first wire member 10' on which an inner skin layer is laminated, and then the first wire member 10' is passed through a second co-extruder 80 to make a second wire member 10" on which an insulation layer and an outer skin layer are subsequently laminated.

First, seeing the process of making the first wire member 10', copper or its alloy with a thickness of 0.5 mm is processed into a ring shape to make a central conductor 10 having a hollow cylindrical shape with a diameter of 9 to 19 mm. And then, the central conductor 10 is progressed in an advancing direction of the wire member at a predetermined speed and then supplied to the first co-extruder 70 provided with a first resin supplier 71. At this time, polyolefin resin is put into the first resin supplier 71.

The central conductor 10 supplied to the first co-extruder 70 is co-extruded such that an inner skin layer is laminated on its outer circumference, and then the central conductor 10 is supplied to the second co-extruder 80. That is to say, polyolefin resin in a melted state is coated on the outer circumference of the central conductor 10 as a thin film with a thickness of 0.01 to 1 mm such that the central conductor 10 is made into the first wire member 10'.

In this embodiment, the first co-extruder 70 is set such that its inside is kept at temperature of 140° C. and pressure of 100 bar, and a speed of the central conductor 10 passing through the first co-extruder 70 is set to be 10 m/min.

Then, the first wire member 10' supplied to the second co-extruder 80 is co-extruded such that an insulation layer and an outer skin layer are laminated on its outer circumference. Here, the second co-extruder 80 is provided with a second resin supplier 81 and a third resin supplier 82. At this time, 85 wt % of HDPE and 15 wt % of LDPE are put into the second resin supplier 81, and polymer resin including polyethylene resin, polypropylene resin and polyethylene terephthalate resin is put into the second resin supplier 82.

The first wire member 10' supplied to the second co-extruder 70 is successively doubly co-extruded such that an insulation layer and an outer skin layer are subsequently laminated on its outer circumference.

That is to say, physically foamed polyethylene resin is laminated on the outer circumference of the first wire member 10' in a thickness of 6 to 14 mm, and then polymer resin in a melted state is coated on its outer circumference as a thin film with a thickness of 0.01 to 0.5 mm, thereby making the second wire member 10". At this time, this foaming is performed in a way that a mixed gas supplied from outside is injected into the polyethylene resin in a melted state till an overfoaming state.

In this embodiment, the outer skin layer is rapidly cooled while passing through a nozzle 83, thereby controlling overfoaming while foam cells are created in the insulation layer, ensuring uniform creation of the foam cells in the insulation layer, and making the foam cells adjacent to each other. At this time, the foam cells have a size of 100 to 1000 μm on the basis of an average diameter of long and short axes in a closed-cell shape.

In this embodiment, the second co-extruder 80 is set such that its inside is kept at temperature of 140° C. and pressure of 100 bar, and a speed of the first wire member 10' that passes through the second co-extruder 80 is set to be 10 m/min.

After that, a shield and a sheath are subsequently laminated on the second wire member 10" to make a foam coaxial cable, which is however well known in the art and thus not described in detail here.

The foam coaxial cable manufactured as above may have an insulation layer that has foam cells with a uniform size, as explained below with reference to FIGS. 4 to 6. At this time, FIG. 4 is a photograph showing sections of the insulation layer and the outer skin layer according to the preferred embodiment of the present invention, and FIGS. 5 and 6 are photographs showing sections of insulation layers according to comparative examples.

Referring to FIG. 4, foam cells in the insulation layer according to the present invention have closed pores with uniform size and high degree of foam. In addition, the foam cells are successively formed adjacently with each other with keeping the closed pores, respectively. Also, the inner skin layer and the outer skin layer that form boundaries with the insulation layer contain polymer resin of the same composition, and there is no deformation of foam cells in the boundaries.

Meanwhile, referring to FIGS. 5 and 6, conventional foam cells according to the comparative examples are burst without keeping closed pores, elongated in association with adjacent foam cells, or sparsely created without being successively adjacent to each other.

As density and uniformity of the foam cells are improved, permittivity is lowered. Also, as the permittivity is lowered, a loss characteristic according to signal propagation is improved. It will be explained below with reference to FIGS. 7 and 8. At this time, FIG. 7 is a graph showing a loss characteristic of the foam coaxial cable according to the preferred embodiment of the present invention, and FIG. 8 is a graph showing a loss characteristic of a foam coaxial cable according to the comparative example.

Seeing FIG. 7, the foam coaxial cable of the present invention has improved dielectric and loss characteristics due to uniform foaming, so attenuation compared frequency is 5.4 dB at 2 GHz, and 6.9 dB at 3 GHz. Meanwhile, seeing FIG. 8, in the conventional foam coaxial cable, as frequency is increased, a loss is also increased due to irregular foaming, so attenuation compared with frequency is 6.15 dB at 2 GHz, and 8.03 dB at 3 GHz.

As understood from the above embodiment and comparative example, the foam coaxial cable of the present invention shows 10% improvement in its loss characteristic in comparison to the conventional one.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

As described above, since the foam coaxial cable of the present invention is provided with the inner skin layer and the outer skin layer, the cable has an improved interfacial adhesive force between the central conductor and the insulation layer and an improved degree of foam of the foam cells, and also enables to propagate ultra high frequency of GHz level without any signal interference.

Also, since the degree of foam of the insulation layer formed between the inner and outer skin layers is improved, it is easy to make a large-caliber coaxial cable and propagate a large amount of signals at a super-high speed.

In addition, since the inner and outer skin layers control abnormal growth of foam cells and do not cause any difference of dielectric characteristics between the central conductor and the shield, the foam coaxial cable of the present invention may control generation of group delay and thus ensure good signal characteristics.

The invention claimed is:

1. A foam coaxial cable, comprising:

a central conductor;

an inner skin layer surrounding an outer circumference of the central conductor on the basis of the central conductor;

an insulation layer surrounding an outer circumference of the inner skin layer on the basis of the central conductor and made of polyethylene resin containing a plurality of foam cells uniformly formed therein;

wherein the inner skin layer is made of polyolefin resin having excellent compatibility with the polyethylene resin so as to increase an interfacial adhesive force with the insulation layer, an outer skin layer surrounding an outer circumference of the insulation layer on the basis of the central conductor so as to prevent overfoaming of the insulation layer and allow uniform creation of foam cells;

a shield surrounding the outer skin layer on the basis of the central conductor; and a jacket surrounding the shield.

2. The foam coaxial cable according to claim 1, wherein the foam cells have a size of 100 to 1000μm on the basis of an average diameter of long and short axes thereof.

3. The foam coaxial cable according to claim 2, wherein the central conductor is a hollow cylinder with an outer diameter of 9 to 19 mm.

4. The foam coaxial cable according to claim 3, wherein the inner skin layer is a thin film coating layer made of polyolefin resin with a thickness of 0.01 to 1 mm.

5. The foam coaxial cable according to claim 4, wherein the outer skin layer is an overfoaming prevention layer made of polymer resin with a thickness of 0.01 to 0.5 mm.

6. The foam coaxial cable according to claim 5, wherein the polymer resin is made of a single material or a mixture of at least two materials selected from the group consisting of polyethylene resin, polypropylene resin and polyethylene terephthalate resin.

7. The foam coaxial cable according to claim 6, wherein the insulation layer is a foam insulation layer made of polyethylene resin with a thickness of 5 to 15 mm.

8. The foam coaxial cable according to claim 2, wherein the inner skin layer is a thin film coating layer made of polyolefin resin with a thickness of 0.01 to 1 mm.

9. The foam coaxial cable according to claim 8, wherein the outer skin layer is an overfoaming prevention layer made of polymer resin with a thickness of 0.01 to 0.5 mm.

10. The foam coaxial cable according to claim 9, wherein the polymer resin is made of a single material or a mixture of at least two materials selected from the group consisting of polyethylene resin, polypropylene resin and polyethylene terephthalate resin.

11. The foam coaxial cable according to claim 10, wherein the insulation layer is a foam insulation layer made of polyethylene resin with a thickness of 5 to 15 mm.

12. A method for manufacturing a foam coaxial cable, which includes a central conductor, an insulation layer formed out of the central conductor, a shield formed out of the insulation layer, and a jacket formed on an outer circumference of the shield, the method comprising:

(A) co-extruding a polyolefin resin in a melted state on an outer circumference of the central conductor to form an inner skin layer coated as a thin film thereon with a thickness between 0.01 to 0.1 mm;

(B) co-extruding a polyethylene resin on an outer circumference of the inner skin layer to form an insulation layer having a thickness between 5 to 15 mm and uniformly including a plurality of foam cells with a size between 100 to 1000 μm on the basis of an average diameter of long and short axes thereof;

(C) co-extruding a polymer resin, which is made of the same material as the insulation layer, on an outer circumference of the insulation layer to form an outer skin layer coated as a thin film thereon with a thickness between 0.01 to 0.5 mm; and (D) forming the shield and the jacket on an outer circumference of the outer skin layer.

13. The method for manufacturing a foam coaxial cable according to claim 12, wherein the physical foaming in the step (B) is conducted in a way of injecting a mixed gas of carbon dioxide, nitrogen and Freon into a polyethylene resin in a melted state to reach a supersaturated state such that a plurality of foam cells are created in the insulation layer.

14. The method for manufacturing a foam coaxial cable according to claim 13, wherein the polymer resin of the step (C) is made of a single material or a mixture of at least two materials selected from the group consisting of polyethylene resin, polypropylene resin and polyethylene terephthalate resin.

* * * * *